US005827805A

United States Patent [19]

Adams et al.

[11] Patent Number: 5,827,805

[45] Date of Patent: Oct. 27, 1998

[54] CONDENSATES OF ALKYL PHENOLS AND GLYOXAL AND PRODUCTS DERIVED THEREFROM

[75] Inventors: Paul E. Adams, Willoughby Hills; Bryan A. Grisso, Wickliffe; Mark R. Baker, Lyndhurst, all of Ohio

[73] Assignee: The Lubrizol Corporation, Wickliffe, Ohio

[21] Appl. No.: 609,568

[22] Filed: Feb. 29, 1996

[51] Int. Cl.[6] ..... C10M 129/00; C10L 1/18

[52] U.S. Cl. ..... 508/198; 508/199; 508/200; 508/454; 508/452; 508/463; 508/516; 508/518; 44/314; 44/388; 44/408; 44/410; 549/307; 562/469; 562/478

[58] Field of Search ..... 562/478; 549/307; 508/198, 199, 200, 463, 516, 518

[56] References Cited

U.S. PATENT DOCUMENTS

| | | | |
|---|---|---|---|
| 2,320,241 | 5/1943 | Jenkins | 508/523 |
| 2,862,956 | 12/1958 | Gundel et al. | 560/73 |
| 2,933,520 | 4/1960 | Bader et al. | 560/57 |
| 3,038,935 | 6/1962 | Gerber et al. | 562/468 |
| 3,471,537 | 10/1969 | Berke et al. | 556/114 |
| 3,493,516 | 2/1970 | Allphen et al. | 508/392 |
| 3,707,447 | 12/1972 | Alexander | 562/478 |
| 3,862,133 | 1/1975 | Layer | 549/310 |
| 4,013,690 | 3/1977 | Closse et al. | 549/307 |
| 4,182,720 | 1/1980 | Renfrew et al. | 549/310 |
| 4,252,817 | 2/1981 | Closse et al. | 562/478 |
| 4,384,138 | 5/1983 | Karll et al. | 562/478 |
| 4,627,928 | 12/1986 | Karn | 508/460 |
| 4,695,648 | 9/1987 | Agback et al. | 562/478 |
| 4,888,132 | 12/1989 | Kohashi et al. | 562/478 |
| 5,006,270 | 4/1991 | Farng et al. | 508/198 |
| 5,076,945 | 12/1991 | Habeeb et al. | 508/518 |
| 5,175,312 | 12/1992 | Dubs et al. | 549/307 |
| 5,240,624 | 8/1993 | Koch | 508/200 |
| 5,281,346 | 1/1994 | Adams et al. | 508/305 |
| 5,296,614 | 3/1994 | Henkelmann et al. | 549/307 |
| 5,306,833 | 4/1994 | Vallejos et al. | 562/478 |
| 5,330,666 | 7/1994 | Habeeb | 508/518 |
| 5,336,278 | 8/1994 | Adams et al. | 44/419 |
| 5,356,546 | 10/1994 | Blystone et al. | 508/478 |
| 5,395,964 | 3/1995 | Vallejos et al. | 562/478 |
| 5,441,653 | 8/1995 | Cleveland et al. | 508/270 |
| 5,457,226 | 10/1995 | Gugax | 562/478 |
| 5,516,920 | 5/1996 | Nesvadba et al. | 549/307 |

FOREIGN PATENT DOCUMENTS

| | | | |
|---|---|---|---|
| 2244992 | 12/1991 | United Kingdom | 562/478 |

OTHER PUBLICATIONS

Chem. Abstract 87:201105h, *Phenylacetic acid derivatives,* Closse et al, 1977.

Chem. Abstract 87: 23030v, *Benzofuran derivatives,* Closse et al, 1977.

Chem. Abstract 84: 17121x, *Carbocylic compounds,* Closse et al, 1976.

Aldrich Catalog/Handbook, 1994/95 edition, p. 805, discloses 2–hydroxyphenylacetic acid, $HOC_6H_4CH_2CO_2H$, *Beil.* 10, 187 (no month).

Aldrich Catalog/Handbook, 1994/95 edition, p. 387, discloses 2–coumaranone, *Beil.*. 309 (no month).

Beilsteins Handbuch der Organishcen Chemie, vol. 10 p. 187, 1927, Berlin, Prager, editor, discloses 2–oxy–phenylacetic acid and methods of its synthesis, e.g., by heating 2–oxymandelic acid with hydriodic acid. (no month).

*Primary Examiner*—Ellen M. McAvoy

*Attorney, Agent, or Firm*—David M. Shold; Frederick D. Hunter

[57] ABSTRACT

Compositions represented by the structures

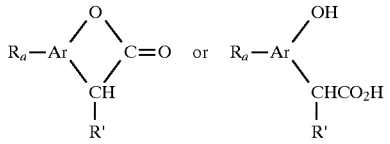

where Ar represents an aromatic group, each R is independently a hydrocarbyl group, at least one R having more than 12 carbon atoms, a is 1 to 4, and R' is hydrogen or alkyl, are useful as lubricant and fuel additives and as intermediates for the preparation of derivatives useful as such additives.

76 Claims, No Drawings

CONDENSATES OF ALKYL PHENOLS AND GLYOXAL AND PRODUCTS DERIVED THEREFROM

BACKGROUND OF THE INVENTION

The present invention relates to reaction products of hydrocarbyl substituted aromatic hydroxy compounds with a glyoxal and additives prepared therefrom.

U.S. Pat. No. 3,862,133, Layer, Jan. 21, 1975, discloses γ lactones of o-hydroxyphenylacetic acids, prepared by reacting a hydroxybenzene compound and glyoxal using an acidic catalyst. R substituents on the hydroxybenzene can include alkyl, preferably having 1 to 12 carbon atoms. The products may be used to prepare new rubbers and plastics by ring opening polymerization. 4,7-di-t-butyl-5-hydroxybenzofuran-2(3H)-one has antioxidant activity and acts as a stabilizer.

U.S. Pat. No. 5,281,346, Adams, Jan. 25, 1994, discloses a two-cycle engine lubricant comprising alkali or alkaline earth metal salts of carboxylic aromatic acids having a formula (II)

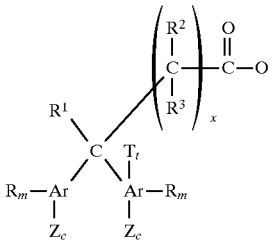

wherein T is selected from the group consisting of

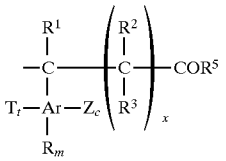

or

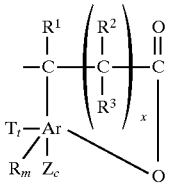

U.S. Pat. No. 5,356,546, Blystone et al, Oct. 18, 1994, discloses metal salts similar to those of U.S. Pat. No. 5,281,346. The salts find utility in lubricants and fuels other than 2-cycle engine lubricants and fuels.

U.S. Pat. No. 2,320,241, Jenkins, May 25, 1943, discloses a lubricating oil composition which includes lactone forming acids of the type represented by

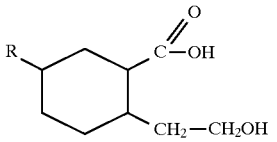

SUMMARY OF THE INVENTION

The present invention provides a composition represented by the structure

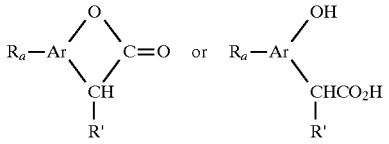

where Ar represents an aromatic group, each R is independently a hydrocarbyl or substituted hydrocarbyl group, at least one R having more than 12 carbon atoms, a is 1 to 4, and R' is hydrogen or alkyl.

The invention further comprises the reaction product of an alkyl-substituted aromatic hydroxy compound and glyoxal or a mono-hydrocarbyl-substituted glyoxal or a source thereof, where the alkyl group on the aromatic hydroxy compound comprises at least 8 carbon atoms. The invention also provides a process for preparing the condensation product of such materials, comprising combining the alkyl substituted hydroxyaromatic material and the glyoxal or substituted glyoxal or source thereof with a catalytic amount of a strong acid, heating the mixture, and removing the water of condensation. The invention further includes the process of combining the materials with a non-acidic inert diluent, in the substantial absence of carboxylic acids of 1 to 4 carbon atoms; heating the mixture; and removing the water of condensation.

The invention also includes the reaction product of the above materials with an amine or ammonia or with an alkylene oxide, or salts of the above materials with a quaternary ammonium ion or a metal ion.

The invention also includes lubricant, fuel, or concentrate compositions which include any of the above materials.

DETAILED DESCRIPTION OF THE INVENTION

The initial reaction product.

The present invention relates the reaction product of a hydrocarbyl-substituted aromatic hydroxy compound and glyoxal or a mono-alkyl-substituted glyoxal. The first component which will be described is the hydrocarbyl-substituted aromatic hydroxy compound.

The aromatic group of the hydroxyaromatic compound can be a single aromatic nucleus such as a benzene nucleus, a pyridine nucleus, a thiophene nucleus, a 1,2,3,4-tetrahydronaphthalene nucleus, etc., or a polynuclear aromatic moiety. Such polynuclear moieties can be of the fused type; that is, wherein pairs of aromatic nuclei making up the aromatic group share two points, such as found in naphthalene, anthracene, the azanaphthalenes, etc. Polynuclear aromatic moieties also can be of the linked type wherein at least two nuclei (either mono or polynuclear) are linked through bridging linkages to each other. Such bridging linkages can be chosen from the group consisting of carbon-to-carbon single bonds between aromatic nuclei, ether linkages, keto linkages, sulfide linkages, polysulfide linkages of 2 to 6 sulfur atoms, sulfinyl linkages, sulfonyl linkages, methylene linkages, alkylene linkages, di-(lower alkyl) methylene linkages, lower alkylene ether linkages, alkylene keto linkages, lower alkylene sulfur linkages, lower alkylene polysulfide linkages of 2 to 6 carbon atoms, amino linkages, polyamino linkages and mixtures of such divalent bridging linkages. In certain instances, more than one bridging linkage can be present in the aromatic group between aromatic nuclei. For example, a fluorene nucleus has two benzene nuclei linked by both a methylene linkage and a covalent bond. Such a nucleus may be considered to have 3 nuclei but only two of them are aromatic. Normally, the aromatic group will contain only carbon atoms in the aromatic nuclei per se, although other non-aromatic substitution, such as in particular short chain alkyl substitution can also be present. Thus methyl, ethyl, propyl, and t-butyl groups, for instance, can be present on the aromatic groups, even though such groups may not be explicitly represented in structures set forth herein.

This first reactant, being a hydroxy aromatic compound, can be referred to as a phenol. When the term "phenol" is used herein, however, it is to be understood, depending on the context, that this term need not limit the aromatic group of the phenol to benzene, although benzene may be the preferred aromatic group. Rather, the term is to be understood in its broader sense to include, depending on the context, for example, substituted phenols, hydroxy naphthalenes, and the like. Thus, the aromatic group of a "phenol" can be mononuclear or polynuclear, substituted, and can include other types of aromatic groups as well.

Specific examples of single ring aromatic moieties are the following:

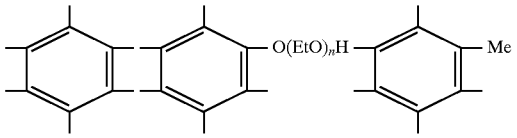

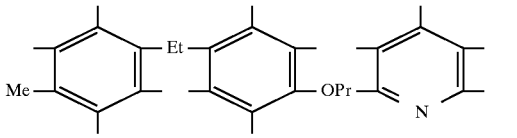

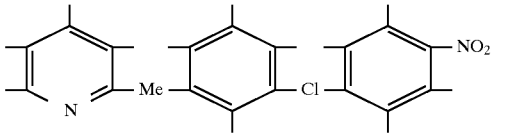

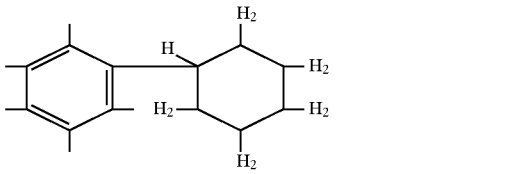

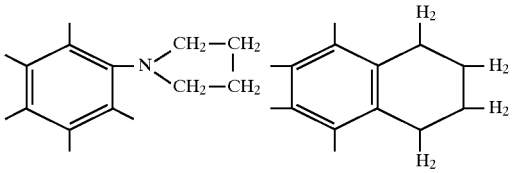

etc., wherein Me is methyl, Et is ethyl or ethylene , as appropriate, and Pr is n-propyl.

Specific examples of fused ring aromatic moieties are:

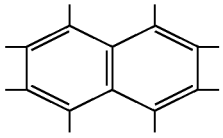

-continued

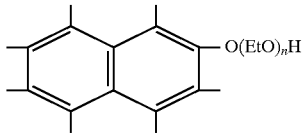

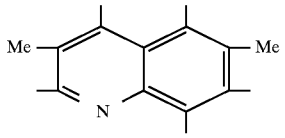

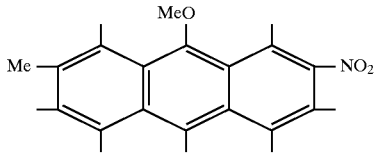

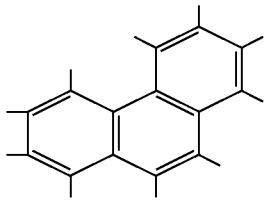

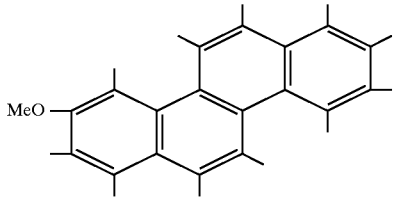

etc.

When the aromatic moiety is a linked polynuclear aromatic moiety, it can be represented by the general formula $$ar(—L—ar—)_w$$

wherein w is an integer of 1 to about 20, each ar is a single ring or a fused ring aromatic nucleus of 4 to about 12 carbon atoms and each L is independently selected from the group consisting of carbon-to-carbon single bonds between ar nuclei, ether linkages (e.g. —O—), keto linkages $$(\text{e.g., } -\overset{\overset{\displaystyle O}{\|}}{C}-),$$

sulfide linkages (e.g., —S—), polysulfide linkages of 2 to 6 sulfur atoms (e.g., $—S—_{2\text{-}6}$), sulfinyl linkages (e.g., —S(O)—), sulfonyl linkages (e.g., $—S(O)_2—$), lower alkylene linkages $$(\text{e.g., } -CH_2-,\ -CH_2-CH_2-,\ -CH_2-\underset{\underset{\displaystyle R^o}{|}}{CH}-),$$

mono(lower alkyl)-methylene linkages (e.g., $—CHR^0—$), di(lower alkyl)-methylene linkages (e.g.,$—CR^0{}_2—$), lower alkylene ether linkages $$(\text{e.g., } -CH_2O-,\ -CH_2O-CH_2-,\ -CH_2-CH_2O-,$$

-continued $$-CH_2CH_2OCH_2CH_2-,\ -CH_2\underset{\underset{R^o}{|}}{C}HOCH_2\underset{\underset{R^o}{|}}{C}H-,$$

$$-CH_2\underset{\underset{R^o}{|}}{C}HO\underset{\underset{R^o}{|}}{C}HCH_2-,\ \text{etc.}),$$

lower alkylene sulfide linkages (e.g., wherein one or more —O—'s in the lower alkylene ether linkages is replaced with a S atom), lower alkylene polysulfide linkages (e.g., wherein one or more —O—is replaced with a $—S_{2-6}—$ group), amino linkages $$(\text{e.g.},\ -\underset{\underset{H}{|}}{N}-,\ -\underset{\underset{R^o}{|}}{N}-,\ -CH_2N-,\ -CH_2NCH_2-,\ \text{-alk-N-},$$

where alk is lower alkylene, etc.), polyamino linkages (e.g., $—N(alkN)_{1-10}$, where the unsatisfied free N valences are taken up with H atoms or $R^0$ groups), linkages derived from oxo- or keto- carboxylic acids (e.g.)

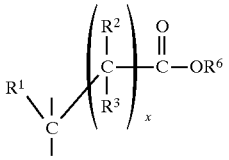

wherein each of $R^1$, $R^2$ and $R^3$ is independently hydrocarbyl, preferably alkyl or alkenyl, most preferably lower alkyl, or H, $R^6$ is H or an alkyl group and x is an integer ranging from 0 to about 8, and mixtures of such bridging linkages (each $R^0$ being a lower alkyl group).

Specific examples of linked moieties are:

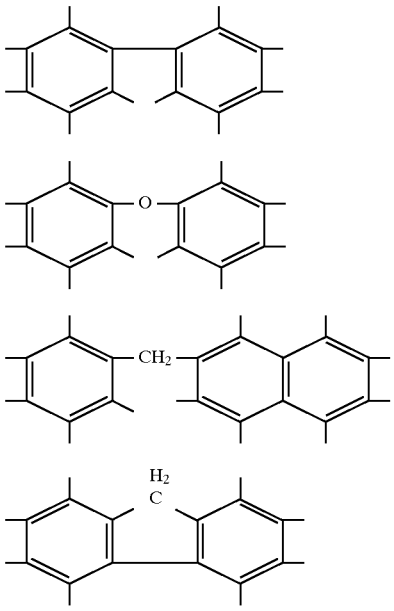

-continued

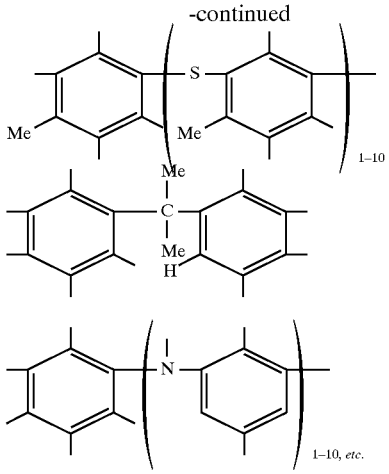

Usually all of these Ar groups have no substituents except for those specifically named. For such reasons as cost, availability, performance, etc., the aromatic group is normally a benzene nucleus, a lower alkylene bridged benzene nucleus, or a naphthalene nucleus. Most preferably the aromatic group is a benzene nucleus.

This first reactant is a hydroxyaromatic compound, that is, a compound in which at least one hydroxy group is directly attached to an aromatic ring. The number of hydroxy groups per aromatic group will vary from 1 up to the maximum number of such groups that the hydrocarbyl-substituted aromatic moiety can accommodate while still retaining at least one, and preferably at least two, positions, at least some of which are preferably adjacent (ortho) to a hydroxy group, which are suitable for further reaction by condensation with aldehydes (described in detail below). Thus most of the molecules of the reactant will have at least two unsubstituted positions. Suitable materials can include, then, hydrocarbyl-substituted catechols, resorcinols, hydroquinones, and even pyrogallols and phloroglucinols. Most commonly each aromatic nucleus, however, will bear one hydroxyl group and, in the preferred case when a hydrocarbyl substituted phenol is employed, the material will contain one benzene nucleus and one hydroxyl group. Of course, a small fraction of the aromatic reactant molecules may contain zero hydroxyl substituents. For instance, a minor amount of non-hydroxy materials may be present as an impurity. However, this does not defeat the spirit of the inventions, so long as the starting material is functional and contains, typically, at least one hydroxyl group per molecule.

The hydroxyaromatic reactant is similarly characterized in that at least some of the units of which are hydrocarbyl substituted. Typically most or all of the molecules are hydrocarbyl substituted, so as to provide the desired hydrocarbon-solubility to the product molecules. If the hydroxyaromatic compound comprises bridged ring units, then preferably substantially all such units are hydroxyl- and hydrocarbyl-substituted; that is, each ring unit which is linked by a bridging group to another ring unit, will preferably have at least one hydroxyl substituent and at least one hydrocarbyl substituent. The term "hydrocarbyl substituent" or "hydrocarbyl group" is used herein in its ordinary sense, which is well-known to those skilled in the art. Specifically, it refers to a group having a carbon atom directly attached to the remainder of the molecule and having predominantly hydrocarbon character. Examples of hydrocarbyl groups include:

(1) hydrocarbon substituents, that is, aliphatic (e.g., alkyl or alkenyl), alicyclic (e.g., cycloalkyl, cycloalkenyl)

substituents, and aromatic-, aliphatic-, and alicyclic-substituted aromatic substituents, as well as cyclic substituents wherein the ring is completed through another portion of the molecule (e.g., two substituents together form an alicyclic radical);

(2) substituted hydrocarbon substituents, that is, substituents containing non-hydrocarbon groups which, in the context of this invention, do not alter the predominantly hydrocarbon substituent (e.g., halo (especially chloro and fluoro), hydroxy, alkoxy, mercapto, alkylmercapto, nitro, nitroso, and sulfoxy);

(3) hetero substituents, that is, substituents which, while having a predominantly hydrocarbon character, in the context of this invention, contain other than carbon in a ring or chain otherwise composed of carbon atoms. Heteroatoms include sulfur, oxygen, nitrogen, and encompass substituents as pyridyl, furyl, thienyl and imidazolyl. In general, no more than two, preferably no more than one, non-hydrocarbon substituent will be present for every ten carbon atoms in the hydrocarbyl group; typically, there will be no non-hydrocarbon substituents in the hydrocarbyl group.

Preferably the hydrocarbyl group is an alkyl group. Typically at least one alkyl group will contain at least 8 carbon atoms, preferably more than 12, e.g., 13 to 144 carbon atoms, preferably 14 to 72 carbon atoms, and more preferably 18 to 30 carbon atoms. Additional hydrocarbyl groups of lower molecular weight can also be present. Alternatively expressed, at least one alkyl group should preferably have a number average molecular weight of 180 to 2000, preferably 200 to 1000, more preferably 250 to 500.

When the hydrocarbyl is an alkyl or alkenyl group having 8 to 28 carbon atoms, it is typically derived from the corresponding olefin; for example, a dodecyl group is derived from dodecene, an octyl group is derived from octene, etc. When the hydrocarbyl group is a hydrocarbyl group having at least about 30 carbon atoms, it is frequently an aliphatic group made from homo- or inter-polymers (e.g., copolymers, terpolymers) of mono- and di-olefins having 2 to 10 carbon atoms, such as ethylene, propylene, butene-1, isobutene, butadiene, isoprene, 1-hexene, 1-octene, etc. Typically, these olefins are 1-mono olefins such as homopolymers of ethylene. These aliphatic hydrocarbyl groups can also be derived from halogenated (e.g., chlorinated or brominated) analogs of such homo- or interpolymers. Such groups can, however, be derived from other sources, such as monomeric high molecular weight alkenes (e.g., 1-tetracontene) and chlorinated analogs and hydrochlorinated analogs thereof, aliphatic petroleum fractions, particularly paraffin waxes and cracked and chlorinated analogs and hydrochlorinated analogs thereof, white oils, synthetic alkenes such as those produced by the Ziegler-Natta process (e.g., poly(ethylene) greases) and other sources known to those skilled in the art. Any unsaturation in the hydrocarbyl groups may be reduced or eliminated by hydrogenation according to procedures known in the art.

In one embodiment, at least one hydrocarbyl group is derived from polybutene. In another embodiment, the hydrocarbyl group is derived from polypropylene. In a further embodiment, the hydrocarbyl substituent is a propylene tetramer.

More than one such hydrocarbyl group can be present, but usually no more than 2 or 3 are present for each aromatic nucleus in the aromatic group. When the aromatic group is a benzene ring, preferably at least one R group is positioned para to the oxygen atom of the hydroxy group.

The attachment of a hydrocarbyl group to the aromatic moiety of the first reactant of this invention can be accomplished by a number of techniques well known to those skilled in the art. One particularly suitable technique is the Friedel-Crafts reaction, wherein an olefin (e.g., a polymer containing an olefinic bond), or halogenated or hydrohalogenated analog thereof, is reacted with a phenol in the presence of a Lewis acid catalyst. Methods and conditions for carrying out such reactions are well known to those skilled in the art. See, for example, the discussion in the article entitled, "Alkylation of Phenols" in "KirkOthmer Encyclopedia of Chemical Technology", Third Edition, Vol. 2, pages 65–66, Interscience Publishers, a division of John Wiley and Company, N.Y. Other equally appropriate and convenient techniques for attaching the hydrocarbon-based group to the aromatic moiety will occur readily to those skilled in the art.

Specific illustrative examples of hydrocarbyl-substituted hydroxyaromatic compounds include hydrocarbon substituted-phenol, naphthol, 2,2'-dihydroxybiphenyl, 4,4-dihydroxybiphenyl, 3-hydroxyanthracene, 1,2,10-anthracenetriol, and resorcinol; octyl phenol, cresols, propylene tetramer-substituted phenol, propylene oligomer ($M_n$ 300–800)-substituted phenol, polybutene ($M_n$ about 1000) substituted phenol, substituted naphthols corresponding to the above exemplified phenols, methylene-bis-phenol, bis-(4-hydroxyphenyl)-2,2-propane, and hydrocarbon substituted bis-phenols, for example, octyl, dodecyl, oleyl, polybutenyl, etc., sulfide-and polysulfide-linked analogues of any of the above, alkoxylated derivatives of any of the above hydroxy aromatic compounds, etc.

The composition of matter of the present invention is the reaction product of the above-described substituted hydroxyaromatic compound with glyoxal or a mono-alkyl-substituted glyoxal. This material is represented by the structure R'—C(=O)—C(=O)—H, where R' is H, for glyoxal, or alternatively R' is an alkyl group. Glyoxal itself is commercially available as a 40% solution in water; in such a condition it likely exists in a mono- or poly-hydrated form, e.g., $HC(OH)_2$—$CH(OH)_2$. It can also exist in oligomeric forms, such as glyoxal trimeric dihydrate, and can also be supplied in chemically equivalent forms such as the dioxime. All such forms are considered reactively equivalent to glyoxal and are considered to be encompassed by the term "glyoxal" or are to be considered a source of glyoxal.

Mono-alkyl-substituted glyoxals include pyruvic aldehyde (where R'=$CH_3$), 1,2-butanedione, and 1,2-pentanedione.

The hydroxyaromatic compound and the glyoxal or hydrocarbyl-substituted glyoxal or source thereof, are typically reacted in the presence of a catalytic amount of a strong acid, preferably a strong organic acid with heating and concurrent removal of water of condensation. The heating is typically in the range of 70° to 200° C., normally 100° to 150° C., preferably 120° to 130° C., over a sufficient period of time to permit the desired extent of reaction, preferably substantially complete reaction. Depending on reaction conditions such as the temperature, the time of reaction will typically be 10 minutes to 24 hours, preferably 1 to 10 hours, more preferably 2 to 8 hours.

The strong acid can be any acid with a $pK_a$ generally less than about 5, preferably less than about 2.5, 2.0, or 1.5, in water. Examples include mineral acids such as sulfuric acid, sulfurous acid, phosphoric acid, phosphorous acid, hydrochloric acid, and hydrobromic acid. Other suitable acids include strong acids such as heteropolyacids (e.g., $H_3PW_{12}O_{40}$) and partial salts thereof, trifluoroacetic acid, and sulfonic acids, which are especially useful. Among sulfonic acids are included alkanesulfonic acids such as methanesulfonic acid, arenesulfonic acids such as p-toluenesulfonic acid, and polymeric sulfonic acids. Alkanesulfonic acids are preferred, and among these, methanesulfonic acid is particularly preferred. A catalytic amount is employed, that is, typically 0.5 to 5 mole percent based on the amount of hydrocarbyl-substituted hydroxyaromatic material, preferably 1–3 mole percent. Alternatively, suitable amounts can be expressed as 0.05 to 10 weight percent, preferably 0.1 to 5 weight percent, more preferably 1 to 3 weight percent, based on the total composition, depending on the particular chemicals employed.

The total reaction composition can also contain a non-acidic inert (or comparatively inert) diluent. That is, in a preferred embodiment the reaction composition is substantially free from carboxylic acids of 1 to 4 carbon atoms such as acetic acid. It is preferably also prepared in the absence of chlorine-containing materials. The non-acidic inert diluent can be a solvent such as toluene, xylenes, ethylbenzenes, other aromatic solvents, heptane, and other relatively volatile solvents, synthetic poly-alpha-olefins, poly(ethylene glycol), or a mineral oil such as paraffin-containing basestocks. The amount of the diluent is typically 5 to 80 percent by weight of the reaction composition, preferably 5 to 50 percent by weight, more preferably 10 to 30 percent by weight. In a preferred process the concentration of the hydrocarbyl-substituted hydroxyaromatic compound is 0.2 to 5 moles/L, preferably 0.5 to 2 moles/L and more preferably 1 to 1.5 moles/L. The concentration of the glyoxal or substituted glyoxal or source thereof is preferably 0.1 to 5 moles/L, more preferably 0.2 to 2 moles/L, and still more preferably 0.5 to 1.5 moles/L.

The product of the aforedescribed reaction is believed to be a material having a structure generally represented by

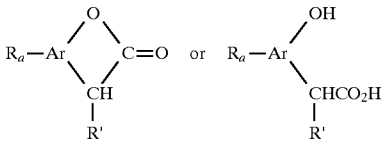

where Ar represents an aromatic group, each R is independently a hydrocarbyl group, e.g., an alkyl or substituted alkyl group (including aralkyl groups such as those derived from styrene), at least one R having more than 12 carbon atoms, a, the number of such R groups, is 1 to 4, and R' is hydrogen or alkyl, preferably of up to 4 carbon atoms. Whether the material is in the lactone form, left, or the hydroxy acid form, right, will depend on conditions of reaction or hydrolysis and the specific nature of the Ar, R, and R' groups. For the purposes of the present invention the two forms are generally considered equivalent.

In the preferred case, Ar is a benzene ring, and the OH group and $CHR'CO_2H$ groups are located ortho to each other. Thus the lactone shown will have a 5-membered lactone ring. A particularly preferred material, prepared from unsubstituted glyoxal, has a structure represented by

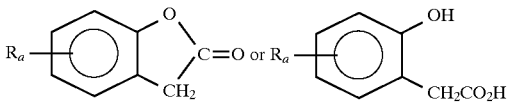

Alternatively, the afore-described materials can function as intermediates which can be further treated or reacted to provide other useful additives.

The reaction product with amine or ammonia

The materials can be reacted with ammonia or another amine to form products, typically ammonium or amine salts, amides, or imides. The amines can be monoamines or polyamines. The monoamines and polyamines are preferably characterized by the presence within their structure of at least one H—N<group. Therefore, they preferably have at least one primary (i.e., $H_2N$—) or secondary amine (i.e., 1 H—N<) group, although tertiary amines (i.e. —$NR_3$) can also be used (e.g., to form salts). The amines can be aliphatic, cycloaliphatic, aromatic, or heterocyclic, including aliphatic-substituted cycloaliphatic, aliphatic-substituted aromatic, aliphatic-substituted heterocyclic, cycloaliphatic-substituted aliphatic, cycloaliphatic-substituted aromatic, cycloaliphatic-substituted heterocyclic, aromatic-substituted aliphatic, aromatic-substituted cycloaliphatic, aromatic-substituted heterocyclic-substituted alicyclic, and heterocyclic-substituted aromatic amines, and can be saturated or unsaturated. The amines can also contain non-hydrocarbon substituents or groups so long as these groups do not significantly interfere with the reaction of the amines with the initial reaction product of this invention. Such non-hydrocarbon substituents or groups include lower alkoxy, lower alkyl mercapto, nitro, interrupting groups such as —O— and —S— (e.g., as in such groups as —$CH_2CH_2$—X—$CH_2CH_2$—where X is —O—or —S—). In general, the preferred amines can be characterized by the formula $R^7R^8NH$ wherein $R^7$ and $R^8$ are each independently hydrogen or hydrocarbon, amino-substituted hydrocarbon, hydroxy-substituted hydrocarbon, alkoxy-substituted hydrocarbon, amino, carbamyl, thiocarbamyl, guanyl, and acylimidoyl groups, provided that only one of $R^7$ and $R^8$ can be hydrogen.

For the purposes of the present invention, hydrazine ($H_2N$—$NH_2$) and substituted hydrazines ($R^1R^2N$—$NR^3R^4$) are also considered to fall within the broad definition of "amine," and are thus included as suitable reactants for the present invention. That is, in the above formula, $R^7$ or $R^8$ could also be $R^1R^2N$.

With the exception of the branched polyalkylene polyamines, the polyoxyalkylene polyamines, and the high molecular weight hydrocarbyl-substituted amines described more fully hereafter, the amines ordinarily contain fewer than 40 carbon atoms in total and usually not more than 20 carbon atoms in total.

Aliphatic monoamines include mono-aliphatic, di-aliphatic, and tri-aliphatic substituted amines wherein the aliphatic group can be saturated or unsaturated and straight or branched chain. Thus, they are primary or secondary aliphatic amines. Such amines include, for example, mono-, di, and tri-alkyl-substituted amines, mono-, di, and tri-alkenyl-substituted amines, and amines having one N-alkenyl substituent and one N-alkyl substituent. The total number of carbon atoms in these aliphatic monoamines will, as mentioned before, normally not exceed 40 and usually not exceed 20. Specific examples of such monoamines include ethylamine, diethylamine, triethylamine, n-butylamine, di-n-butylamine, tri-n-butylamine, allylamine, isobutylamine, cocoamine, stearylamine, laurylamine, methyllaurylamine, oleylamine, N-methyl-octylamine, dodecylamine, and octadecylamine. Examples of cycloaliphatic-substituted aliphatic amines, aromatic-substituted aliphatic amines, and heterocyclic-substituted aliphatic amines, include 2-(cyclohexyl)ethylamine, benzylamine, phenethylamine, and 3-(furylpropyl)amine.

Cycloaliphatic monoamines are those monoamines wherein there is one cycloaliphatic substituent attached directly to the amino nitrogen through a carbon atom in the cyclic ring structure. Examples of cycloaliphatic monoamines include cyclohexylamines, cyclopentylamines, cyclohexenylamines, cyclopentenylamines, N-ethyl-cyclohexylamine, dicyclohexylamines, and the like. Examples of aliphatic-substituted, aromatic-substituted, and heterocyclic-substituted cycloaliphatic monamines include propyl-substituted cyclohexylamines, phenyl-substituted cyclopentylamines, and pyranyl-substituted cyclohexylamine.

Aromatic amines include those monoamines wherein a carbon atom of the aromatic ring structure is attached directly to the amino nitrogen. The aromatic ring will usually be a mononuclear aromatic ring (i.e., one derived from benzene) but can include fused aromatic rings, especially those derived from naphthalene. Examples of aromatic monoamines include aniline, di-(paramethylphenyl) amine, naphthylamine, and N,N-di(butyl)aniline. Examples of aliphatic-substituted, cycloaliphatic-substituted, and heterocyclic-substituted aromatic monoamines are para-ethoxyaniline, para-dodecylaniline, cyclohexyl-substituted naphthylamine, and thienyl-substituted aniline.

The amine which reacts with the first product of the present invention can also be a polyamine. The polyamine can be aliphatic, cycloaliphatic, heterocyclic or aromatic. Examples of the polyamines include alkylene polyamines, hydroxy-containing polyamines, arylpolyamines, and heterocyclic polyamines.

Alkylene polyamines are represented by the formula

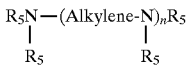

$$R_5N-(\text{Alkylene-}N)_nR_5$$
$$\quad\;\; |\qquad\qquad\quad |$$
$$\quad\;\; R_5\qquad\qquad R_5$$

wherein n has an average value from 1, or about 2 to about 10, or to about 7, or to about 5, and the "Alkylene" group has from 1 or 2 to 10, or to 6, or to 4 carbon atoms. Each $R_5$ is independently hydrogen, or an aliphatic or hydroxy-substituted aliphatic group of up to preferably 30 carbon atoms. Preferably at least one $R_5$ is a hydrogen. In one embodiment, $R_5$ is defined as hydrocarbyl.

Such alkylenepolyamines include methylenepolyamines, ethylenepolyamines, butylenepolyamines, propylenepolyamines, and pentylenepolyamines. The higher homologs and related heterocyclic amines such as piperazines and N-aminoalkyl-substituted piperazines are also included. Specific examples of such polyamines are ethylenediamine, diethylenetriamine (DETA), triethylenetetramine (TETA), tris-(2-aminoethyl)amine, propylenediamine, trimethylenediamine, tripropylenetetramine, tetraethylenepentamine, hexaethyleneheptamine, and pentaethylenehexamine.

Higher homologs obtained by condensing two or more of the above-noted alkylene amines are similarly useful, as are mixtures of two or more of the aforedescribed polyamines.

Ethylenepolyamines, such as those mentioned above, are useful. Such polyamines are described in detail under the heading Ethylene Amines in Kirk Othmer's "Encyclopedia of Chemical Technology", 2d Edition, Vol. 7, pages 22–37, Interscience Publishers, New York (1965). Such polyamines are most conveniently prepared by the reaction of ethylene dichloride with ammonia or by reaction of an ethylene imine with a ring opening reagent such as water, ammonia, etc. These reactions result in the production of a complex mixture of polyalkylenepolyamines including cyclic condensation products such as the aforedescribed piperazines. Ethylenepolyamine mixtures are also useful.

Other useful types of polyamine mixtures are those resulting from stripping of the above-described polyamine mixtures to leave as residue what is often termed "polyamine bottoms". In general, alkylenepolyamine bottoms can be characterized as having less than two, usually less than 1% (by weight) material boiling below about 200° C. A typical sample of such ethylene polyamine bottoms obtained from the Dow Chemical Company of Freeport, Tex. designated "E-100" has a specific gravity at 15.6° C. of 1.0168, a percent nitrogen by weight of 33.15 and a viscosity at 40° C. of 121 centistokes. Gas chromatography analysis of such a sample contains about 0.93% "Light Ends" (most probably diethylenetriamine, DETA), 0.72% triethylenetetramine (TETA), 21.74% tetraethylene pentamine, and 76.61% pentaethylenehexamine and higher (by weight). These alkylenepolyamine bottoms include cyclic condensation products such as piperazine and higher analogs of diethylenetriamine, triethylenetetramine and the like.

These alkylenepolyamine bottoms can be reacted solely with the initial product of the present invention, or they can be used with other amines, polyamines, or mixtures thereof.

Another useful polyamine is a condensation reaction between at least one hydroxy compound with at least one polyamine reactant containing at least one primary or secondary amino group. The hydroxy compounds are preferably polyhydric alcohols and amines. The polyhydric alcohols are described above. Preferably the hydroxy compounds are polyhydric amines. Polyhydric amines include any of the above-described monoamines reacted with an alkylene oxide (e.g., ethylene oxide, propylene oxide, butylene oxide) having two to 20, or to four carbon atoms. Examples of polyhydric amines include tri-(hydroxypropyl)amine, tris-(hydroxymethyl)amino methane, 2-amino-2-methyl-1, 3-propanediol, N,N,N',N'-tetrakis(2-hydroxypropyl)ethylenediamine, and N,N,N',N'-tetrakis(2-hydroxyethyl)ethylenediamine, preferably tris (hydroxymethyl)aminomethane (THAM).

Preferred polyamine reactants include triethylenetetramine (TETA), tetraethylenepentamine (TEPA), pentaethylenehexamine (PEHA), and mixtures of polyamines such as the above-described "amine bottoms".

In another embodiment, the amines are hydroxy-containing polyamines. Hydroxy-containing polyamine analogs of hydroxymonoamines, particularly alkoxylated alkylenepolyamines (e.g., N,N(diethanol)ethylenediamine) may also be used. Such polyamines may be made by reacting the above-described alkylenepolyamines with one or more alkylene oxides. Similar alkylene oxidealkanolamine reaction products may also be used such as the products made by reacting primary, secondary or tertiary alkanolamines with ethylene, propylene or higher epoxides in a 1:1 to 1:2 molar ratio. Reactant ratios and temperatures for carrying out such reactions are known to those skilled in the art.

Specific examples of alkoxylated alkylene polyamines include N-(2-hydroxyethyl)ethylenediamine, N,N-bis(2-hydroxyethyl)ethylenediamine, 1-(2-hydroxyethyl) piperazine, mono(hydroxypropyl)substituted tetraethylenepentamine, and N-(3-hydroxybutyl) tetramethylene diamine. Higher homologs obtained by condensation of the above-illustrated hydroxy-containing polyamines through amino groups or through hydroxy groups are likewise useful. Condensation through amino groups results in a higher amine accompanied by removal of ammonia while condensation through the hydroxy groups results in products containing ether linkages accompanied by removal of water. Mixtures of two or more of any of the aforesaid polyamines are also useful.

In another embodiment, the amine is a heterocyclic polyamine. The heterocyclic polyamines include aziridines, azetidines, azolidines, pyridines, pyrroles, indoles, piperidines, imidazoles, piperazines, isoindoles, purines, morpholines, thiomorpholines, N-aminoalkylmorpholines, N-aminoalkylthiomorpholines, N-aminoalkylpiperazines, N,N'-diaminoalkylpiperazines, azepines, azocines, azonines, azecines and tetra-, di- and perhydro derivatives of each of the above and mixtures of two or more of these heterocyclic amines. Preferred heterocyclic amines are the saturated 5- and 6-membered heterocyclic amines containing only nitrogen, oxygen and/or sulfur in the hetero ring, especially the piperidines, piperazines, thiomorpholines, morpholines, pyrrolidines, and the like. Piperidine, aminoalkyl-substituted piperidines, piperazine, aminoalkyl-substituted piperazines, morpholine, aminoalkyl-substituted morpholines, pyrrolidine, and aminoalkyl-substituted pyrrolidines, are also preferred. Usually the aminoalkyl substituents are substituted on a nitrogen atom forming part of the hetero ring. Specific examples of such heterocyclic amines include N-aminopropylmorpholine, N-aminoethylpiperazine, and N,N'-diaminoethylpiperazine. Hydroxy heterocyclic polyamines are also useful. Examples include N-(2-hydroxyethyl)cyclohexylamine, 3-hydroxycyclopentylamine, parahydroxyaniline, and N-hydroxyethylpiperazine.

The amine can be reacted with the phenol-glyoxal condensate by mixing the components, either neat or in solution, and heating the mixture for a period of time and to a temperature sufficient for reaction to occur to the desired extent. Numerous types of products are possible, depending on the nature of the specific reactants and the severity of the reaction conditions. Under relatively gentle conditions, an amine salt may form. Under somewhat more severe conditions, condensation to an amide may occur. Reaction typically occurs at room temperature, around 25° C., e.g., 20°–50° C.; alternatively, the reaction can be effected by heating to 50° to 180° C. or 80° to 160° C. or 100° to 130° C.

The reaction product with salt-forming compounds

The condensation product of the phenol and the glyoxal can be reacted with basic compounds to form salts. The salts can be amine salts or, preferably, metal salts, where the metal is one or more metal ions. These include alkali metal, alkaline earth metals, zinc, cadmium, lead, cobalt, nickel, iron, manganese, copper and others. Preferred are the alkali and alkaline earth metals. Especially preferred are sodium, potassium, calcium, and lithium. Most preferred are sodium and calcium.

The metal ions can be derived from reactive metals or reactive metal compounds that will react with the phenolic functionality or the carboxylic acid or lactone functionality of the present compounds to form carboxylates or phenates. The metal salts can be prepared from reactive metals such as alkali metals, alkaline earth metals, zinc, lead, cobalt, nickel, iron and the like. Examples of reactive metal compounds are sodium oxide, sodium hydroxide, sodium carbonate, sodium methylate, sodium phenoxide, corresponding potassium and lithium compounds, calcium oxide, calcium hydroxide, calcium carbonate, calcium methylate, calcium chloride, calcium phenoxide, and corresponding barium and magnesium compounds, zinc oxide, zinc hydroxide, zinc carbonate, cadmium chloride, lead oxide, lead hydroxide, lead carbonate, nickel oxide, nickel hydroxide, cobalt oxide, ferrous carbonate, ferrous oxide, and cupric acetate. Alternatively, reactive metal compounds can be prepared in situ by mixing, for example, an alkali metal carboxylate and a metal halide, such as cupric, zinc, or nickel chloride.

The salts can be neutral salts, partially neutralized salts, or overbased salts. Preferably, the salts comprises no more than about 30% unreacted carboxylic acid groups or lactone, more preferably, no more than about 15% and even more preferably, no more than about 5% unreacted carboxylic acid or lactone.

The neutral or partially neutralized metal salts of Formula (I) of this invention may be readily prepared by reacting the acid or lactone of the present invention with a metal-containing reactant to form a salt under conventional salt-forming conditions.

Overbased materials are single phase, homogeneous, generally Newtonian systems characterized by a metal content in excess of that which would be present according to the stoichiometry of the metal and the particular acidic organic compound reacted with the metal. The amount of excess metal is commonly expressed in terms of metal ratio. The term "metal ratio" is the ratio of the total equivalents of the metal to the equivalents of the acidic organic compound. A neutral metal salt has a metal ratio of one. A salt having 4.5 times as much metal as present in a normal salt will have metal excess of 3.5 equivalents, or a ratio of 4.5. The basic salts of the present invention have a metal ratio of at least 1.3, preferably at least 1.5, preferably up to 40, more preferably 20, and even more preferably 10. A preferred metal ratio is 2–6.

The basicity of the overbased materials of the present invention generally is expressed in terms of a total base number. A total base number is the amount of acid (perchloric or hydrochloric) needed to neutralize all of the overbased material's basicity, expressed as potassium hydroxide equivalents. The overbased materials of the present invention generally have a total base number of at least 20, preferably 100, more preferably 200. The overbased material generally have a total base number up to 600, preferably 500, more preferably 400.

The overbased materials of the present invention are prepared by reacting an acidic material (typically an inorganic acid or lower carboxylic acid, preferably carbon dioxide) with a mixture comprising the initial lactone or carboxylic acid product of the present invention, a reaction medium comprising at least one inert, organic solvent (mineral oil, naphtha, toluene, xylene, etc.), a stoichiometric excess of a metal base, and a promoter.

The metal compounds useful in making the basic metal salts are generally the same compounds useful for preparing neutral salts, preferably, any Group I or Group II metal compounds (CAS version of the Periodic Table of the Elements). The Group I metals of the metal compound include alkali metals (sodium, potassium, lithium, etc.) as well as metals such as copper. The Group I metals are preferably sodium, potassium, lithium and copper, more preferably sodium or potassium, and more preferably sodium. The Group II metals include the alkaline earth metals (magnesium, calcium, barium, etc.) as well as the metals such as zinc or cadmium. Preferably the Group II metals are magnesium, calcium, or zinc, preferably magnesium or calcium, more preferably calcium. Generally the metal compounds are delivered as metal salts. The anionic portion of the salt can be hydroxyl, oxide, carbonate, borate, nitrate, etc.

While overbased metal salts can be prepared by merely combining an appropriate amount of metal base and carboxylic acid substrate, the formation of useful overbased compositions is facilitated by the presence of an additional acidic material, such as carbon dioxide, as described above. When $CO_2$ is employed, the product is referred to as a carbonate overbased (or carbonated) material; when $SO_2$, sulfite overbased (or sulfited); when $SO_3$, sulfate overbased (or sulfated). When sulfite overbased materials are further treated with elemental sulfur or an alternative sulfur source, thiosulfate overbased materials can be prepared.

A promoter is a chemical employed to facilitate the incorporation of metal into the basic metal compositions.

The promoters are quite diverse and are well known in the art, as evidenced by the cited patents. A particularly comprehensive discussion of suitable promoters is found in U.S. Pat. Nos. 2,777,874, 2,695,910, and 2,616,904. These include alcoholic and phenolic promoters, which are preferred. A particularly useful class of phenols are the alkylated phenols of the type listed in U.S. Pat. No. 2,777,874, e.g., heptylphenols, octylphenols, and nonylphenols. Mixtures of various promoters are sometimes used.

The reaction product with alkylene oxides

Any of the preceding products can be further reacted by treatment with reactants such as alkylene oxides (e.g., ethylene oxide, propylene oxide, butylene oxide, epichlorohydrin, glycidol, butadiene monoxide, 1-amylene oxide, epoxidized fatty oils, epoxy stearic acid) typically having 2 to 20 or preferably 2 to 4 carbon atoms. The reaction conditions will depend on the particular reactants, but generally the reaction is carried out at a temperature of 25° C. to 250° C., preferably 30° C. to 150° C. It can be carried out under pressure if a reactant, such as ethylene oxide or propylene oxide, is gaseous or volatile. In some instances it may be preferable to facilitate the reaction by using a catalyst, typically a basic catalyst. The product of such reaction will depend on the particular material which is reacted. If the lactone or acid material or a salt is reacted, the product will generally be a polyalkylene oxide ester, i.e., an ether-ester. If the amine adduct is reacted, the product will generally be a hydroxyamine, although use of different types of amines will lead to correspondingly different types of products, as will be apparent to the person skilled in the art.

Borated products

Any of the foregoing products, including the lactone, acid, amine product, salt, and alkylene oxide derivatives thereof, can also be further reacted, if desired, with a boronating agent. Boronating agents (also referred to as borating agents) include the various forms of boric acid (including metaboric acid, $HBO_2$, orthoboric acid, $H_3BO_3$, and tetraboric acid, $H_2B_4O_7$), polymers of boric acid, boron anhydride, boron esters, boron halides such as boron trifluoride, boric oxide, boron trioxide, and alkyl borates of the formula $(RO)_xB(OH)_y$ wherein x is 1 to 3 and y is 0 to 2, the sum of x and y being 3, and where R is an alkyl group containing 1 to 6 carbon atoms. The reaction of the product with a boronating agent is conducted under conditions which will vary with the specific reactants employed, but in general will involve adding the borating agent to the material to be borated, heating the mixture until reaction ensues, and isolating the borated product.

In the particular case where the reaction is with an overbased materials, the reaction will generally involve addition of a borating agent (such as boric acid) to the overbased material, maintaining the mixture, with agitation, at 50° to 200° C., e.g., about 100° C., for 0.5 to 7, preferably 1 to 3 hours, stripping off volatile materials at about 150° C., optionally under vacuum, and isolating the product as a filtrate. In a preferred embodiment, it is sometimes desired to prepare the overbased borated product by (a) mixing a carbonated overbased material and any required inert liquid medium, (b) borating the mixture (a) with a borating agent at a temperature less than that at which substantial foaming occurs (e.g., less than 110° C., preferably less than 99° C.), (c) raising the temperature of the mixture (b) to a temperature in excess of the boiling point of water within the mixture (e.g., 120°–180° C.), (d) separating substantially all of the water from the reaction mixture (c) while retaining substantially all of the carbonate in the mixture (c), and (e) recovering the product (d) as a high carbonate content borated product. Details of this boronation treatment are set forth in greater detail in U.S. Pat. No. 4,792,410.

Reaction of one of the amine products with a boronating agent can be effected by adding the boron reactant to the amine product in a suitable reaction vessel, and heating the resulting reaction mixture to 50° to 300° C., preferably 100° to 250° C., more preferably 150° to 230° C., with stirring. The reaction is continued until byproduct water ceases to evolved from the reaction mixture, indicating completion of the reaction. The removal of byproduct water is facilitated by either blowing an inert gas, such as nitrogen, over the surface of the reaction mixture, or by conducting the reaction at reduced pressures. Further details of this boronation treatment are set forth in greater detail in U.S. Pat. No. 4,622,158.

Any of the afore-described materials, whether the initial reaction product or the further reaction products with amine or ammonia, salt-forming compounds, alkylene oxides, or borating agents, are useful additives for lubricant compositions, fuel compositions, or other fluid compositions such as functional fluids. As such they can impart properties of dispersancy, detergency, evenness of combustion, fuel combustion chamber deposit control, fuel intake valve deposit control, diesel and fuel injector deposit control, 2-cycle piston varnish cleanliness, and antiwear properties.

When the materials are employed as an additive for a lubricant, they will typically be used in an amount of 0.1 to 15 percent by weight of the lubricant, preferably 0.5 to 3 percent by weight. When they are employed as an additive for a fuel, they will typically be used in an amount of 25 parts per million to 20 percent by weight, the particular amount depending on the application. Thus when employed as an additive in ordinary liquid fuels, they will preferably be used in an amount of 50 to 5,000 parts per million by weight of the fuel, and more preferably 100 to 1000 parts per million. However, when they are used as an additive for lubrication of two-cycle engines, they will typically be used in an amount of 0.1 to 20 or, preferably, 10 percent by weight of the fuel, preferably 0.5 to 2 percent by weight. Additives for two-cycle engine fuels, as is well known, typically also perform a lubricating function in the engine and are often separately supplied as a component in an oil which is to be mixed with the fuel. As such the instant materials will typically be present (in the oil) in comparatively higher amounts, e.g., 0.5 or 1 to 20, preferably 2 to 8 percent of the oil. When the additives are employed in other industrial fluids, such as functional fluids, they will be employed in amounts, typically within the above-described ranges, which provide the desired level of performance, as will be readily apparent to those skilled in the art. The additives can also be present as concentrates in a concentrate-forming amount of a diluent, typically an oil, for ease of handling. Such concentrates typically contain 2% to 90% by weight of the components described above, often 10 to 20%, and may contain, in addition, one or more other additives known in the art as described hereinabove. The remainder of the concentrate is the substantially inert normally liquid diluent.

EXAMPLES

Example 1

To a 1-L 4-necked flask are charged 346 g dinonylphenol, 174 g glyoxal (40%, aqueous solution), and 2.0 g methanesulfonic acid (70%, aqueous solution). The mixture is heated over 2 hours to 115° C., collecting water in a Dean-Stark trap. The mixture is further heated to 130° C. over 4 hours, continuing to collect water. The mixture is allowed to cool and let stand overnight. The mixture is again heated to 130° C. and maintained at temperature for 6 hours, under nitrogen. The total amount of water collected is 115 g. The reaction mixture is stripped at 115° C. at 6.6 kPa (50 mm Hg), then filtered using a filter aid to provide 285 g product.

Example 2

To a 5-L 4-necked flask are charged 1500 g dinonylphenol, 691.5 g glyoxal (40%), 5.0 g methanesulfonic acid (70%), and 0.1 g silicone antifoam agent. The mixture is heated to 110° C. under nitrogen over 45 minutes, then maintained at 100° C. for 2 hours, heated to 120° C. and maintained for 2 hour, then heated to 130° C. and maintained for 3 hours. A total of 487 g water is collected. The mixture is stripped at 130° C. at 3.3 kPa (25 mm Hg), then filtered using a filter aid to provide 1533.8 g product.

Example 3

To a 3-L flask fitted with subsurface nitrogen inlet and Dean-stark trap with condenser is added 1000 g polybutenyl ($M_n$ 1000) phenol and 130.4 g glyoxal (40%, aqueous). The mixture is heated for ½ hour to 110° C. and 5.5 g methanesulfonic acid (70%, aqueous) is added. The mixture is maintained at 110° C. for 2 hours, then further heated to 130° C. over 3 hours and maintained at temperature for 2 hours. After standing overnight, the reaction mixture is further heated to 130° C. for 3 hours, collecting a total of 95 g water. The mixture is stripped at 130° C., 4.0 kPa (30 mm Hg) for 1 hour, then filtered with filter aid to provide 992.6 g product.

Example 4

To a 3-L flask fitted with subsurface nitrogen inlet and Dean-stark trap with condenser is added 800 g polybutenyl ($M_n$ 1000) phenol, 104.3 g glyoxal (40%, aqueous), and 230 g diluent mineral oil. The mixture is heated for ½ hour to 110° C. and 4.4 g methanesulfonic acid (70%, aqueous) is added. The mixture is maintained at 110° C. for 2 hours, then further heated to 130° C. over 3 hours and maintained at temperature for 2 hours. After standing overnight, the reaction mixture is further heated to 130° C. for 3 hours, while collecting water. The mixture is stripped at 130° C., 4.0 kPa (30 mm Hg) for 1.3 hours, then filtered with filter aid to provide product containing diluent oil.

Example 5

To a 12 L 4-necked flask is charged 2000 g dinonylphenol (from Huntsman) and 751.4 g diluent mineral oil. The mixture is heated, with stirring under nitrogen, to 90° C. To the mixture are added 921.9 g glyoxal (40%, aqueous), 10.0 g methanesulfonic acid (70%, aqueous), and 0.1 g antifoam agent (kerosene solution). The mixture is heated to 105° C. and maintained at this temperature for 6 hours, collecting water in a Dean-Stark trap fitted under a condenser. The mixture is allowed to cool and stand overnight. The mixture is heated to 130° C. over 4 hours, while collecting water (625 g total), and maintained at 130° C. for 3 hours. The mixture is again allowed to cool to room temperature, then again heated to 130° C. and maintained at this temperature for an additional 4 hours. The resulting material is filtered with filter aid. The filtrate is the product.

Example 6

A 4-neck, 1 L flask equipped with stirrer, thermowell, subsurface nitrogen inlet tube, Dean Stark trap, and water condenser is charged with 65 g glyoxal (40%, aqueous), 99 g nonylphenol, and 224 g ethoxylated fatty ($C_{12-13}$) alcohol (Neodol™ 23-6.5, from Shell). The aforementioned chemicals are previously dehydrated in a 3-L flask by heating at 65° C. under reduced pressure (less than 1.3 kPa, 10 mm Hg). Nitrogen is blown into the 1-L flask at 6 L/hr (0.2 std. $ft^3$/hr) and 88 g toluene is added. The mixture is heated to 50° C. and 1.7 g p-toluenesulfonic acid catalyst is added with stirring. Heating is continued to 120° C. with refluxing of the toluene. After 7.5 hours of heating, the heating is stopped and the mixture is allowed to cool to room temperature. A total of 7 mL water is removed during the reaction. The mixture is allowed to stand overnight at room temperature and is thereafter stripped under vacuum at 90° C. A filter aid is added to the mixture, and the mixture filtered hot to yield 302.3 g of a mixture of products including the condensate of the nonylphenol and glyoxal.

Example 7

To a 12-L flask are added 3716 g di-$C_{12}$ alkyl-substituted phenol, 1400 g glyoxal (40%, aqueous), 4.0 L glacial acetic acid, and 180 mL concentrated hydrochloric acid. The mixture is heated under nitrogen at reflux (100°–105° C.) for 18 hours. The reaction mixture is cooled and then stripped under vacuum (0.6 kPa, 5 mm Hg) at 150° C. for 4 hours. The reaction mixture is filtered through filter acid at 140° C. to yield 4064 g product.

Example 8

To a 2-L flask are added 390 g of the n-$C_{16}$ alkylation product of p-cresol, 187 g glyoxal (40%, aqueous), 700 mL acetic acid, and 11 mL concentrated hydrochloric acid. The mixture is heated under nitrogen at 100°–105° C. for 10 hours. The reaction mixture is cooled and then stripped under vacuum (0.6 kPa, 5 mm Hg) at 130° C. for 3 hours. The reaction mixture is filtered through filter acid at 130°–135° C. to yield 435 g product.

Example 9

To a 3-L flask are added 330 g of the n-$C_{15-18}$ alkylation product of o-t-butyl phenol, 128 g glyoxal (40%, aqueous), 700 mL propionic acid, and 15 mL concentrated hydrochloric acid. The mixture is heated under nitrogen at 100°–105° C. for 14 hours. The reaction mixture is cooled and then stripped under vacuum (0.6 kPa, 5 mm Hg) at 145° C. for 3 hours. The reaction mixture is filtered through filter aid at 120°–130° C. to yield 350 g product.

Example 10

To a 3-L flask are added 550 g of the poly(n-butene ($M_n$ 500)) alkylation product of o-cresol, 161 g glyoxal (40%, aqueous), 700 mL acetic acid, and 20 mL concentrated hydrochloric acid. The mixture is heated under nitrogen at 95°–100° C. for 14 hours. The reaction mixture is cooled and then stripped under vacuum (2.7 kPa, 20 mm Hg) at 160° C. for 3 hours. The reaction mixture is filtered through filter aid at 120°–130° C. to yield 545 g product.

Example 11

To a 5-L flask are added 330 g of the 2:1 condensation product of polybutenyl ($M_n$ 1000) phenol and formaldehyde, 194 g glyoxal (40%, aqueous), 1.5 L acetic acid, and 43 mL concentrated hydrochloric acid. The mixture is heated under nitrogen at 102°–105° C. for 22 hours. The reaction mixture is cooled and 500 g diluent oil is added. The mixtures is stripped under vacuum (0.6 kPa, 5 mm Hg) at 150° C. for 3 hours. The reaction mixture is filtered through filter aid at 140° C. to yield 2306 g product.

Example 12

A portion of the product from Example 6, 76 g, and 5.0 mL butylamine (in two portions) are charged to a 1-neck 500 mL flask. The mixture is allowed to stand at room temperature for several hours. An additional 5.0 mL butylamine is charged and the mixture is heated to 100° C. and maintained at temperature for 5 hours. Volatile components are removed under vacuum and the mixture filtered hot through filter paper to yield the product.

Example 13

Example 12 is substantially repeated except that in place of the butylamine is used 3.06 g dimethylaminopropylamine; no extensive heating is supplied. The mixture is filtered warm through filter paper to yield the product.

Example 14

Example 12 is substantially repeated except that in place of the material from Example 1 there is used 65 g of a similar material in which the mole ratio of nonylphenol:glyoxal was about 1:2, and in place of the butylamine is used 5.03 g aminopropylmorpholine. The mixture is filtered warm through filter paper to yield the product.

Example 15

To a 2-L flask are added 440 g material prepared as in Example 11, 6.8 g tetraethylenepentamine, and 200 mL commercial xylenes. The mixture is heated under nitrogen at reflux (145°–150° C.) for 12 hours, collecting 1 mL water in a Dean Stark trap. The mixture is cooled, then stripped at 145° C. under 0.4 kPa (3 mm Hg) pressure. The product is filtered using filter aid at 135°–140° C. to yield 421 g product.

Example 16

To a 2-L flask are added 244 g of material prepared as in Example 7, 50 g calcium hydroxide, 350 mL toluene, and 60 mL water. The mixture is heated at reflux for 6 hours. Infrared analysis shows the absence of lactone. Water is removed at reflux as an azeotrope using a Dean Stark trap. The resulting solution is filtered to remove solids and thereafter stripped on a rotary evaporator to yield 237 g product.

Example 17

To a 3-L flask are added 600 g of material prepared as in Example 7, 85 g potassium hydroxide (technical grade), and 500 mL mixed xylenes. The mixture is heated under nitrogen at 120°–130° C. for 4 hours. Infrared analysis shows the absence of lactone. The mixture is filtered and the solvent removed by rotary evaporation, to provide 660 g product.

Example 18

To a 2-L flask are added 200 g of material prepared as in Example 7, 26 g zinc chloride, 100 g water, 300 mL mixed xylenes, and 197.5 g naphthenic diluent oil. The mixture is heated under nitrogen at reflux (95° C.) for 5 hours. Water is removed as an azeotrope over 2 hours. The remaining material is filtered and stripped on a rotary evaporator, to provide 384 g product.

Example 19

To a 3-L flask are added 300 g of material prepared as in Example 7, 27 g of a commercial sulfonic acid mixture (50%, in diluent oil),340 g diluent oil, 80 g calcium hydroxide, 65 mL methanol, 500 mL xylenes, and 40 g water. The mixture is heated to 78°–80° C. for 1.5 hours, while carbon dioxide is blown into the mixture at 8.5 L/hr (0.3 std. $ft^3$/hr). The mixture is thereafter heated at 78° C. under nitrogen for 4 hours. Water and solvent are stripped at 150° C., first under atmospheric pressure, and thereafter at 2.7 kPa (20 mm Hg). The mixture is filtered using filter aid to provide 605 g product.

Example 20

To a 3-L flask equipped with stirrer, thermowell, reflux condenser, and subsurface tube is charged 962 g of dinonylphenol-glyoxal adduct mixture (75% chemical, 25% diluent oil) and 450 g diluent oil. The mixture is heated with stirring to 45° C. whereupon is added 327 g methanol and 49 g calcium hydroxide. A mixture of 6.4 g acetic acid and 16 g water is added to the flask, and the mixture is held at 55° C. for 1 hour. Thereafter a second charge of 97 g calcium hydroxide is added to the mixture Carbon dioxide is blown into the mixture at 28 L/hr (1.0 std. $ft^3$/hr) for 1.2 hours. The resulting mixture is heated to 150° C. under a nitrogen flow of 28 L/hr (1.0 std. $ft^3$/hr) and held at temperature for 1 hour. The resulting material is cooled to 100° C. and filtered using a filter aid, to provide 1362 g product.

Example 21

To a 2-L flask are added 300 g of material prepared as in Example 8, 104 g calcium hydroxide, 100 mL water, and 400 mL xylenes. The mixture is heated under nitrogen to reflux for 6 hours. Infrared analysis shows the absence of lactone. To the mixture are added 500 mL toluene and 500 mL water and the organic phase collected in a separatory funnel. The organic phase is washed with saturated sodium chloride solution, allowed to stand overnight, and the organic phase collected , dried over sodium sulfate, and stripped on a rotary evaporator, to provide 318 g product.

Example 22

To a 3-L flask are added 290 g of material prepared as in Example 7, 300 mL stock xylenes, 80 g water, 23 g calcium hydroxide, and 180 g diluent oil. The mixture is heated to reflux (92°–93° C.) for 3 hours, at which point infrared analysis indicates the absence of lactone. To the reaction mixture is added 20 g of a commercial sulfonic acid mixture (50%, in diluent oil), 50 g magnesium oxide, and 100 g methanol. The mixture is heated at 69°–72° C. for 6 hours while carbon dioxide is blown into the mixture at 42 L/hr (1.5 std. $ft^3$/hr). Solvent and water are removed by distillation under nitrogen at atmospheric pressure at 150° C. The remaining mixture is vacuum stripped at 150° C. and 1.3 kPa (10 mm Hg) for 1 hour. To the resulting material is added 30 g filter aid, and the product filtered at 150° C. to yield 421 g product.

Example 23

To a 2-L flask are added 280 g of material prepared as in Example 8, which has been further treated with calcium hydroxide to provide the neutral calcium salt, 120 g diluent oil, 190 g xylenes, 30 g of a commercial sulfonic acid mixture (50%, in diluent oil), and 32 g water. The mixture is heated to 60°–65° C., 72 g magnesium oxide, and an additional 44 g water are added. Carbon dioxide is blown into the mixture at 95°–100° C. at 28 L/hr (1.0 std. $ft^3$/hr) for 8 hours. The mixture is vacuum stripped at 150° C. and 1.3 kPa (5 mm Hg) for 3 hours. Product, 460 g, is isolated by filtration.

Example 24

To a 5-L flask are added 592 g of material prepared as in Example 10, 600 mL mixed xylenes, 334 g diluent oil, 43 g calcium hydroxide, and 167 g water. The reaction mixture is heated to 80°–85° C. for 4 hours. Infrared analysis indicates the absence of lactone. To the mixture are added 167 g magnesium oxide, and 33.4 g of a commercial sulfonic acid mixture (50%, in diluent oil), and the mixture is heated to 80°–83° C. while blowing carbon dioxide thereinto at 42 L/hr (1.5 std. $ft^3$/hr) for 7 hours. Water is removed as an azeotrope and the mixture is diluted with 1.0 L toluene. Solids are allowed to settle out and the supernatant solution is filtered. Solvent is stripped at 90°–100° C. and the remaining product filtered using a filter aid at 90°–100° C., to provide 990 g product.

Example 25

To a 2-L, four-necked flask equipped with stirrer, thermowell, reflux condenser, and subsurface tube, is charged 377 g adduct mixture of dinonylphenol with glyoxal (75% chemical, 25% diluent oil), 132 g xylenes, 222 g diluent oil, and 28 g water. The mixture is heated to 60° C. with stirring. To the mixture is added 13 g magnesium oxide, and the mixture is further heated and maintained at reflux (98° C.) for 1 hour. Thereafter the mixture is cooled to 50° C., whereupon is added 40 g methanol, 4 g acetic acid, 17 g water, and 19 g magnesium oxide. Carbon dioxide is blown through the mixture for about 1 hour at 14 L/hr (0.5 std. $ft^3$/hr) at 60° C. The mixture is stripped under atmospheric pressure by heating to 120° C. under a nitrogen flow of 28 L/hr (1.0 std. $ft^3$/hr). Final stripping is accomplished thereafter at 27 kPa (20 mm Hg) at 150° C. The resulting material is cooled to 100° C. and filtered using a filter aid. The filtrate is the product, which is a magnesium salt.

Example 26

To a 1-L 4-necked flask are charged 300 g of reaction product of polyisobutyl ($M_n$ about 1000) substituted phenol plus glyoxal, 18.8 g diethylenetriamine, and 212.5 g diluent oil. The mixture is heated with stirring under nitrogen to 120° C. and maintained at temperature for 5 hours. The mixture is cooled and filtered through filter aid. The filtrate is the product.

Example 27

To a 1-L 4-necked flask are charged 200 g of reaction product of polyisobutyl ($M_n$ about 1000) substituted phenol plus glyoxal and 11.8 g N,N-dimethylaminopropylamine. The mixture is heated, with stirring, under nitrogen to 160° C. and maintained at this temperature for 6 hours. The mixture is cooled to room temperature, then heated to 100° C., 70.6 g commercial aromatic solvent is added, and the mixture is filtered through filter aid. The filtrate (containing the solvent) is the product.

Example 28

To a 1-L 4-necked flask are charged 350 g of reaction product of polyisobutyl($M_n$ about 1000) substituted phenol plus glyoxal (the reaction product containing about 39% diluent oil), 6.36 g polyamine bottoms mixture (polyethyleneamines, from Union Carbide), and 4.2 g diluent oil. The mixture is heated, with stirring, under nitrogen to 160° C. and maintained at this temperature for 6 hours. The mixture is cooled to room temperature, then heated to 140° C. and filtered through filter aid. The filtrate is the product.

Each of the documents referred to above is incorporated herein by reference. Except in the Examples, or where otherwise explicitly indicated, all numerical quantities in this description specifying amounts of materials, reaction conditions, molecular weights, number of carbon atoms, and the like, are to be understood as modified by the word "about." Unless otherwise indicated, each chemical or composition referred to herein should be interpreted as being a commercial grade material which may contain the isomers, by-products, derivatives, and other such materials which are normally understood to be present in the commercial grade. However, the amount of each chemical component is presented exclusive of any solvent or diluent oil which may be customarily present in the commercial material, unless otherwise indicated. As used herein, the expression "consisting essentially of" permits the inclusion of substances which do not materially affect the basic and novel characteristics of the composition under consideration.

What is claimed is:

1. A composition represented by the structure

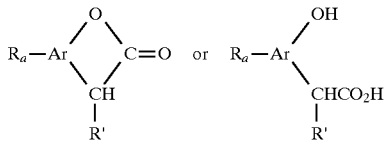

where Ar represents an aromatic group, each R is independently a hydrocarbyl or substituted hydrocarbyl group, at least one R having more than 12 carbon atoms, a is 1 to 4, and R' is hydrogen or an alkyl group containing up to 4 carbon atoms.

2. The composition of claim 1 wherein Ar is a benzene ring and the substituents shown thereon other than the $R_a$ are positioned ortho with respect to each other.

3. The composition of claim 1 wherein Ar is a benzene ring which is substituted by an R group in the position para to the oxygen substituent.

4. The composition of claim 1 wherein at least one R group is an alkyl group containing 13 to about 144 carbon atoms.

5. The composition of claim 1 wherein at least one R group is an alkyl group containing about 14 to about 72 carbon atoms.

6. A fuel composition comprising a liquid fuel and a minor amount of the composition of claim 1 as an additive.

7. The fuel composition of claim 6 wherein the amount of the additive is about 25 parts per million to about 15 percent by weight.

8. The fuel composition of claim 6 wherein the amount of the additive is about 50 to about 5000 parts per million.

9. The fuel composition of claim 6 wherein the amount of the additive is about 0.1 to about 20 percent by weight.

10. The reaction product of the composition of claim 1, or a reactive equivalent thereof, with an amine or ammonia.

11. The reaction product of the composition of claim 1, or a reactive equivalent thereof, with a basic compound to form a salt.

12. The reaction product of the composition of claim 1, or a reactive equivalent thereof, with an alkylene oxide.

13. The reaction product of a hydrocarbyl-substituted aromatic hydroxy compound and glyoxal or a mono-alkyl-substituted glyoxal or a source thereof, where the hydrocarbyl group on the aromatic hydroxy compound comprises more than 12 carbon atoms.

14. A process for preparing the condensation product of a hydrocarbyl-substituted hydroxyaromatic material and glyoxal or a mono-alkyl-substituted glyoxal or a source thereof, comprising combining the hydrocarbyl substituted hydroxyaromatic material and the glyoxal or substituted glyoxal or source thereof with a catalytic amount of a strong organic acid, heating the mixture, and removing the water of condensation.

15. The process of claim 14 wherein the mixture is heated to about 100° to about 150° C.

16. The process of claim 14 wherein a non-acidic inert diluent is included in the mixture and the mixture is substantially free of carboxylic acids of 1 to 4 carbon atoms.

17. The process of claim 16 wherein the non-acidic inert diluent is a mineral oil.

18. The process of claim 16 wherein the amount of the non-acidic inert medium is about 10 to about 50 percent by weight of the mixture.

19. The process of claim 14 wherein the strong organic acid is a sulfonic acid.

20. The process of claim 19 wherein the sulfonic acid is an alkanesulfonic acid.

21. The process of claim 20 wherein the alkanesulfonic acid is methanesulfonic acid.

22. The process of claim 14 wherein the strong organic acid is present in an amount of about 0.5 to about 5 mole percent based on the amount of hydrocarbyl-substituted hydroxyaromatic material.

23. The process of claim 22 wherein the amount of the strong organic acid is about 0.1 to about 5 weight percent based on the total composition.

24. The process of claim 14 conducted in the substantial absence of added chlorine-containing materials.

25. The process of claim 14 wherein the concentration of the hydrocarbyl-substituted hydroxyaromatic compound is about 0.5 to about 2 moles/L and the concentration of the glyoxal or substituted glyoxal is about 0.2 to about 2 moles/L.

26. A process for preparing the condensation product of a hydrocarbyl-substituted hydroxyaromatic material and glyoxal or a mono-alkyl-substituted glyoxal or a source thereof, comprising combining, the hydrocarbyl substituted hydroxyaromatic material, the glyoxal or substituted glyoxal or source thereof, a catalytic amount of a strong acid, and a non-acidic inert diluent, in the substantial absence of carboxylic acids of 1 to 4 carbon atoms; heating the mixture; and removing the water of condensation.

27. The process of claim 26 wherein the mixture is heated to about 100° to about 150° C.

28. The process of claim 26 wherein the non-acidic inert diluent is a mineral oil.

29. The process of claim 26 wherein the amount of the non-acidic inert diluent is about 10 to about 50 percent by weight of the mixture.

30. The process of claim 26 wherein the strong acid is a mineral acid.

31. The reaction product of a composition represented by the structure

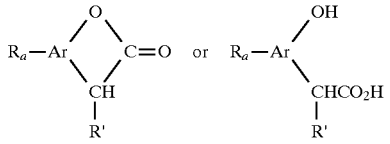

or a reactive equivalent thereof, where Ar represents an aromatic group, each R is independently a hydrocarbyl or substituted hydrocarbyl group, at least one R having at least 8 carbon atoms, a is 1 to 4, and R' is hydrogen or alkyl;

with an amine or ammonia.

32. The reaction product of claim 31 wherein Ar is a benzene ring and the substituents shown thereon other than the $R_a$ are positioned ortho with respect to each other.

33. The reaction product of claim 31 wherein the amine is selected from the group consisting of polyalkyleneamines, hydroxylamines, polyalkanolamines, cyclic amines, amine-terminated polyalkylene oxides, amine dispersants, and amine bottoms.

34. The process of claim 31 wherein the amine is diethylenetriamine.

35. The reaction product of claim 31 wherein the reaction product is further reacted with an alkylene oxide.

36. The reaction product of claim 31 wherein the reaction product is further borated.

37. A lubricating composition comprising an oil of lubricating viscosity and a minor amount of the reaction product of claim 31.

38. The lubricating composition of claim 37 wherein the reaction product comprises about 0.1 to about 15 percent by weight of the composition.

39. A fuel composition comprising a liquid fuel and a minor amount of the composition of claim 31 as an additive.

40. The fuel composition of claim 39 wherein the amount of the additive is about 25 parts per million to about 15 percent by weight.

41. The fuel composition of claim 39 wherein the amount of the additive is about 50 to about 5000 parts per million.

42. The fuel composition of claim 39 wherein the amount of the additive is about 0.1 to about 20 percent by weight.

43. A concentrate comprising the reaction product of claim 31 and a concentrate forming amount of a diluent oil.

44. A salt represented by the structure

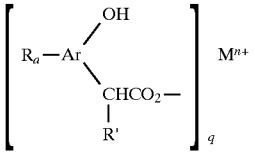

where Ar is an aromatic group, each R is independently a hydrocarbyl or substituted hydrocarbyl group, at least one R group having at least 8 carbon atoms, a is 1 to 4, R' is hydrogen or alkyl, $M^{n+}$ is a quaternary ammonium ion or a metal ion of valence n, and q is a number up to n.

45. The salt of claim 44 wherein Ar is a benzene ring and the substituents shown thereon other than the $R_a$ are positioned ortho with respect to each other.

46. The salt of claim 44 wherein $M^{n+}$ is a metal ion of lithium, sodium, potassium, calcium, magnesium, barium, copper, or zinc.

47. The salt of claim 44 wherein $M^{n+}$ is a metal ion of calcium or magnesium.

48. The salt of claim 44 wherein the salt is reacted with an alkylene oxide.

49. The salt of claim 44 wherein the salt is borated.

50. The salt of claim 44 wherein the salt is overbased.

51. The overbased salt of claim 50 herein the salt is carbonated.

52. A lubricating composition comprising an oil of lubricating viscosity and a minor amount of the salt of claim 44.

53. The lubricating composition of claim 52 wherein the salt comprises about 0.1 to about 15 percent of the composition.

54. A fuel composition comprising a liquid fuel and a minor amount of the composition of claim 44 has an additive.

55. The fuel composition of claim 54 wherein the amount of the additive is about 25 parts per million to about 15 percent by weight.

56. The fuel composition of claim 54 wherein the amount of the additive is about 50 to about 5000 parts per million.

57. The fuel composition of claim 54 wherein the amount of the additive is about 0.1 to about 20 percent by weight.

58. A concentrate comprising the salt of claim 44 and a concentrate forming amount of a diluent oil.

59. The reaction product of a composition represented by the structure

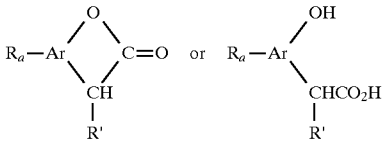

where Ar is an aromatic group, each R is independently a hydrocarbyl or substituted hydrocarbyl group, at least one R having at least 8 carbon atoms, a is 1 to 4, and R' is hydrogen or alkyl, or a reactive equivalent thereof, with an alkylene oxide.

60. The reaction product of claim 59 wherein Ar is a benzene ring and the substituents shown thereon other than the $R_a$ are positioned ortho with respect to each other.

61. The reaction product of claim 59 wherein the alkylene oxide is ethylene oxide or propylene oxide.

62. The reaction product of claim 59 wherein the reaction product is further borated.

63. A lubricating composition comprising an oil of lubricating viscosity and a minor amount of the reaction product of claim 59.

64. The lubricating composition of claim 63 wherein the reaction product comprises about 0.1 to about 15 percent of the composition.

65. A fuel composition comprising a liquid fuel and a minor amount of the reaction product of claim 59 as an additive.

66. The fuel composition of claim 65 wherein the amount of the adduct is about 25 parts per million to about 15 percent by weight.

67. The fuel composition of claim 65 wherein the amount of the additive is about 50 to about 5000 parts per million.

68. The fuel composition of claim 65 wherein the amount of the additive is about 0.1 to about 20 percent by weight.

69. A concentrate comprising the reaction product of claim 59 and a concentrate forming amount of a diluent oil.

70. A composition represented by the structure

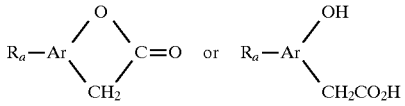

where Ar represents an aromatic group, each R is independently a hydrocarbyl or substituted hydrocarbyl group, at least one R having more than 12 carbon atoms, and a is 1 to 4.

71. A composition represented by the structure

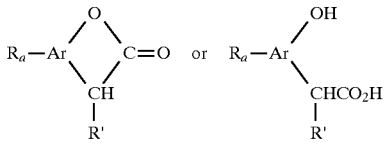

where Ar represents a benzene ring, each R is independently a hydrocarbyl or substituted hydrocarbyl group, at least one R having more than 12 carbon atoms, wherein the benzene ring is substituted by an R group in the position para to the oxygen substituent, where a is 2, and where R' is hydrogen or alkyl.

72. A composition represented by the structure

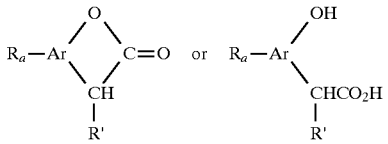

where Ar represents an aromatic group, each R is independently a hydrocarbyl or substituted hydrocarbyl group, at least one R being an alkyl group containing about 18 to about 30 carbon atoms, a is 1 to 4, and R' is hydrogen or alkyl.

73. A composition represented by the structure

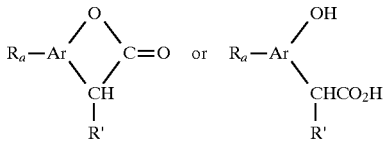

where Ar represents an aromatic group, each R is independently a hydrocarbyl or substituted hydrocarbyl group, at least one R having more than 12 carbon atoms, a is 1 to 4, and R' is hydrogen or alkyl;

wherein the composition is borated.

74. A lubricant composition comprising an oil of lubricating viscosity and, as an additive, a minor amount of a composition represented by the structure

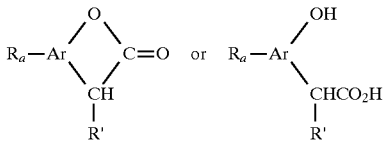

where Ar represents an aromatic group, each R is independently a hydrocarbyl or substituted hydrocarbyl group, at least one R having more than 12 carbon atoms, a is 1 to 4, and R' is hydrogen or alkyl.

75. The lubricant composition of claim 74 wherein the amount of the additive is about 0.1 to about 15 percent by weight of the composition.

76. A concentrate comprising a composition represented by the structure

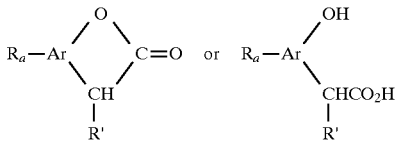

where Ar represents an aromatic group, each R is independently a hydrocarbyl or substituted hydrocarbyl group, at least one R having more than 12 carbon atoms, a is 1 to 4, and R' is hydrogen or alkyl; and a concentrate-forming amount of a diluent oil.

* * * * *

UNITED STATES PATENT AND TRADEMARK OFFICE

CERTIFICATE OF CORRECTION

PATENT NO. :5,827,805
DATED :October 27, 1998
INVENTOR(S) :Paul E. Adams, Bryan A. Grisso, Mark R. Baker, and Richard M. Lange

It is certified that error appears in the above-identified patent and that said Letters Patent is hereby corrected as shown below:

On the title page,

Add the name of Richard M. Lange, as inventor, and his city of residence, Euclid, Ohio.

Signed and Sealed this

Eighteenth Day of May, 1999

*Attest:*

*Attesting Officer*

Q. TODD DICKINSON

*Acting Commissioner of Patents and Trademarks*